United States Patent [19]

Bönström

[11] Patent Number: 4,657,181

[45] Date of Patent: Apr. 14, 1987

[54] RAIL FOR A TRACK BOUND VEHICLE

[76] Inventor: Bengt N. V. Bönström, Igelkottstigen 12, 43080 Hovås, Sweden

[21] Appl. No.: 893,642

[22] Filed: Aug. 6, 1986

Related U.S. Application Data

[63] Continuation of Ser. No. 598,319, Mar. 16, 1984, abandoned.

[30] Foreign Application Priority Data

Jul. 19, 1982 [SE] Sweden ..... 8204380

[51] Int. Cl.[4] ..... E01B 5/04

[52] U.S. Cl. ..... 238/130; 238/136; 238/148

[58] Field of Search ..... 238/24, 25, 26, 122, 238/129, 130, 136, 148

[56] References Cited

U.S. PATENT DOCUMENTS

| | | | |
|---|---|---|---|
| 310,640 | 1/1885 | Beaman | 238/136 |
| 366,507 | 7/1887 | Richards | 238/130 |
| 395,302 | 12/1888 | White | 238/130 |
| 486,211 | 11/1892 | Hunter | 238/130 |
| 706,619 | 8/1902 | West | 238/25 |
| 853,209 | 5/1907 | Akarman | 238/26 |
| 925,261 | 6/1909 | Alden | 238/124 |
| 1,380,725 | 6/1921 | Lundie et al. | 238/125 |
| 1,404,414 | 1/1922 | Wheeler | 238/25 |
| 1,593,895 | 7/1926 | Bittenger | 238/122 X |

FOREIGN PATENT DOCUMENTS

| | | | |
|---|---|---|---|
| 1668 | 3/1883 | United Kingdom | 238/26 |

*Primary Examiner*—Randolph A. Reese
*Assistant Examiner*—David F. Hubbuch

[57] ABSTRACT

A rail for a track-bound vehicle comprising a number of lateral flanges, which can cooperate with a substructure, the flanges extending in an outwards direction from an essentially vertically arranged web provided with a foot, and a portion of a runway rail forming part of a head of the rail and connected with the web. This makes possible a reduction of excavating and substructure work, when laying rails, and a simplified maintenance of the tracks, and in addition also reduces the required number of sleepers. The lateral flanges as seen in the transverse direction relative to the web project to a larger extend than the foot, so that the load operating on the rail will essentially be absorbed by the substructure cooperating with and substantially being located in the area of the lateral flanges.

7 Claims, 2 Drawing Figures

RAIL FOR A TRACK BOUND VEHICLE

This is a continuation of Ser. No. 598,319, filed Mar. 16, 1984, now abandoned.

The present invention relates to a rail for a track-bound vehicle, which rail comprises a number of lateral flanges, which can cooperate with a bed and extend in outwards direction from an essentially vertically arranged web of the rail provided with a foot, said rail also comprising a runway portion forming part of a head of the rail and connected with said web.

It is a principal object of the present invention in the first place to provide a rail of the kind mentioned above, which makes possible an essential reduction of the excavation and foundation work in connection with the laying of rails and also a simplification of the maintenance of the same, and moreover a reduction of the number of sleepers required as well as bed structures of other kinds such as for example concrete slabs.

Said object is obtained by means of a rail according to the present invention, which is substatially characterized by said lateral flanges, as seen in the transversal direction relative to said web of the rail, having a greater degree of projection than the foot of the rail, so that the load operating upon the rail will substantially be absorbed by the foundation, which cooperates with and is substantially located in the area of said lateral flanges.

Figure 1:
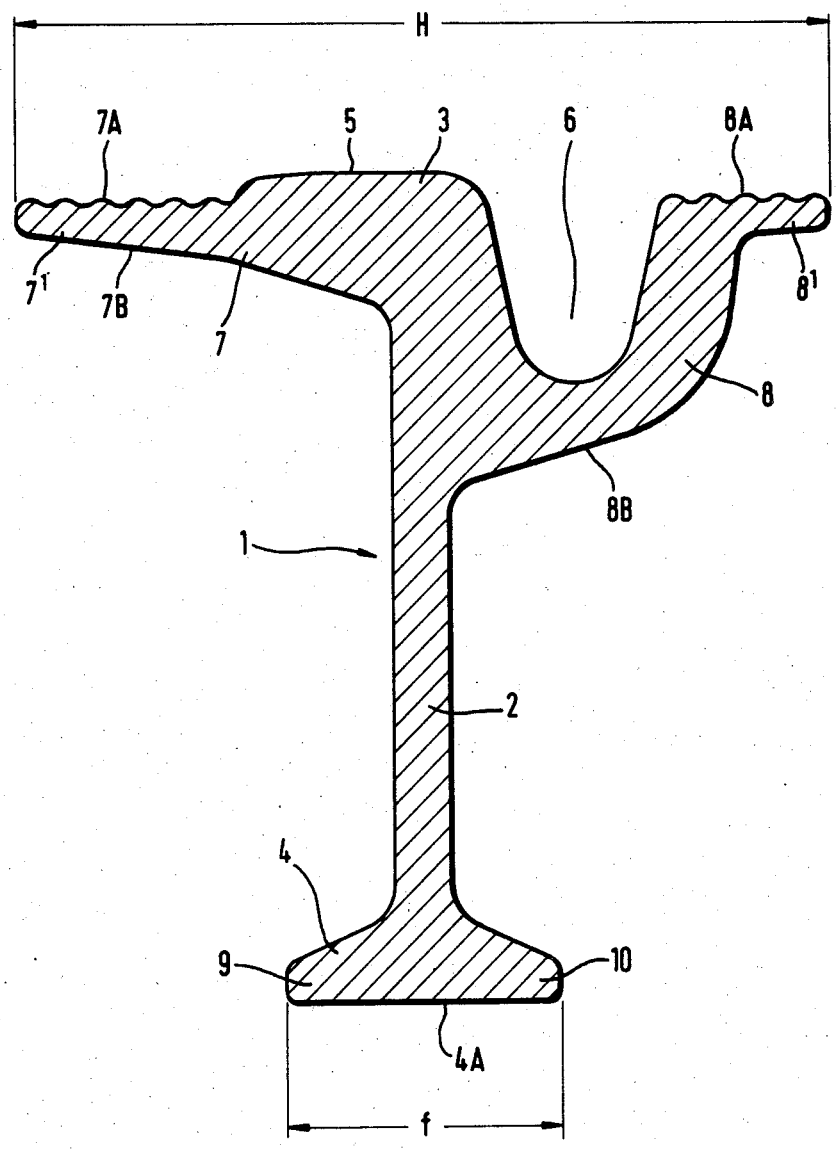

The invention will now be described in the following in the form of an example of embodiment, reference being made to the accompanying drawings, in which FIG. 1 is a cross sectional view of a rail made in accordance with the invention, and FIG. 2 in a schematical manner illustrates the arrangement of a pair of rails according to the present invention, and a pair of conventional rails, as seen in the transversal direction of the track.

A rail according to the present invention and illustrated in the drawing in FIG. 1 is indicated with the digit 1 and has an essentially vertical web 2 of the rail, and a head 3 of the rail rigidly connected with and located at the upper end of said web of the rail and finally a foot 4 of the rail at the lower end of the web. The head 2 of the rail has an upwards facing runway surface 5 extending in the longitudinal direction of the rail, with which the tread of the wheel of a rail-bound vehicle is designed to cooperate while being supported by the same. On at least one side of said runway surface 5 a groove 6 extending in the longitudinal direction of the rail is provided, said groove being open in upwards direction. Said groove 6 is designed to be able to receive a portion of the wheel flange of the wheel of a vehicle, its depth being of sufficient dimension to permit the reception of the wheel flange until the condition arises, when the head of the rail is worn out unto its lower limit.

A first lateral flange 7 essentially projects at right angle from the web 2 of the rail in the area of the head 3 of the rail and the runway surface 5. The upper surface 7A of the lateral flange 7 may be undulated across the longitudinal direction of the rail and is suitably located at a lower level than the level of the runway surface 5, in order to make possible a wear of the running surface 5 to said lower level. A second lateral flange 8 likewise extends in outwards direction from the web 2 of the rail and from the head 3 of the rail but in a completely opposite direction to the one, in which the first lateral flange 7 extends. Said second lateral flange 8 projects from a level, which is lower than the level, from which said first flange projects. The outer portion $8^1$ of said second flange 8 suitable extends up to such a level that the upper surface 8A of the same will be located at substantially the same level as the upper surface 7A of the first flange 7. The groove 6 in the description above being open in upwards direction can be formed in an interspace defined by said second lateral flange 8 and the head 3 of the rail. Also the upper surface 8A of said second lateral flange 8 can be shaped with corrugations, as is the case with the first lateral flange 7. The purpose of said corrugated surfaces 7A, 8A is to provide a top surface that will not be slippery, when the bitumen close to the rail has been worn down, and by this arrangement vehicles and people will be protected from slipping thereon. It is of course possible to apply a different form than the corrugation.

The lower portions of said flanges 7 and 8 respectively are suitably shaped with an inclining surface 7B and 8B.

The foot 4 of the rail likewise has two flanges 9 and 10 respectively, which extend in opposite directions. The underside 4A of the foot of the rail extends in an essentially horizontal direction, as seen in relation to the vertically extending web 2 of the rail.

The idea of the invention aims at designing the lateral flanges 7 and 8 respectively with such a chosen lateral extension that the load operating on the rail will essentially be absorbed by the bed, by way of example broken stone or other ballast and a surface coating, by way of example bitumen, which is intended to cooperate with the lateral flanges 7, 8 and which is located in the area of the same. A suitable relation between the horizontal extension of the lateral flanges 7, 8, which in FIG. 1 is indicated with the letter H, and the width of the foot of the rail, which is indicated with the letter f, is approx. 2:1. An additional preferred relation between the width of the flange H and the width of the foot f is approx. 3:1. The primary and essential feature of the invention consists in the lateral flanges 7,8 projecting to a higher degree than is the case with the foot 4 of the rail, i.e. the relation between H and f has to be $>1$.

Figure 2:
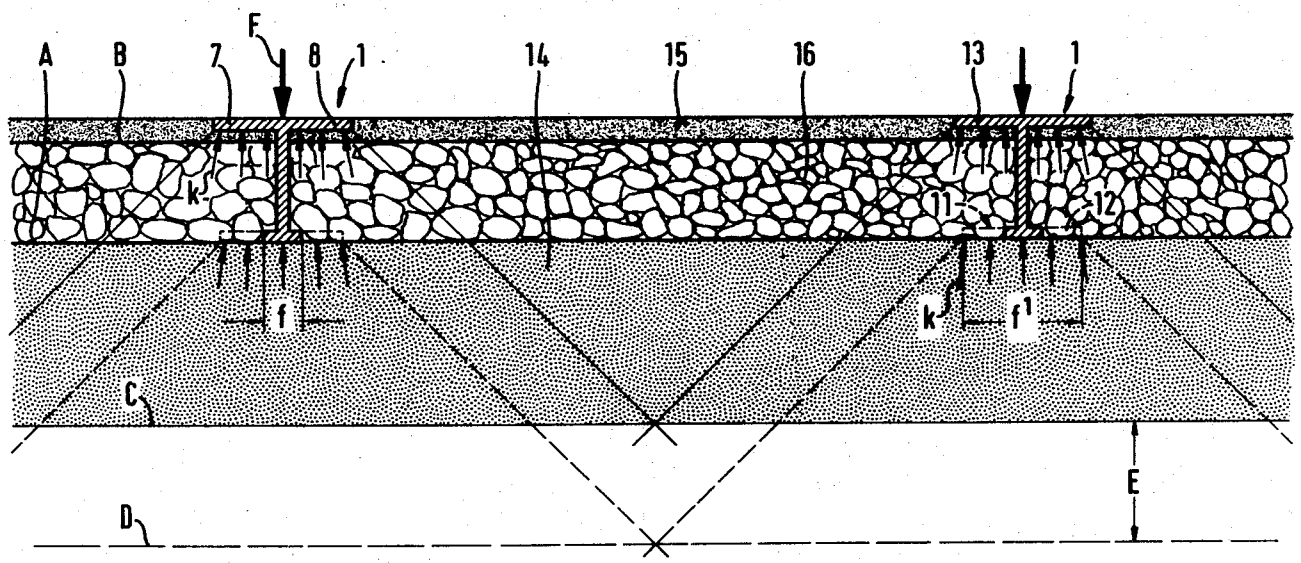

From the schematical FIG. 2 the distribution of tensions in the rail 1 of a track according to the invention and indicated by continous lines and a rail 11 of a track of conventional type exhibiting a wider foot than its head is clearly evident.

Track panels formed by laterally displaced rails 1 and 11 respectively located at a distance from each other, which distance is fixed by means of spacer rods, are supported on a bed at a level A, from which ballast in the form of for example crushed stone is filled up to a level B, from which a surface coating, by way of example bitumen, is deposited up to the upper surfaces 7A and 8A respectively of the lateral flanges 7, 8. The load F operating on each one of the rails 1 and 11 respectively is indicated by a thick arrow, and the forces k working in opposite direction on the rails 1 and 11 respectively are indicated by a number of smaller arrows.

A rail 1 made in accordance with the invention is substantially supported by its upper lateral flanges 7 and 8, while a conventional rail 11 having a width $f^1$ of the foot 12 exceeding the width of its head 13 is supported by said foot 12. The distribution of tensions will then be as is shown with continuous and broken lines respectively. The required level of excavation in an upgrade will for the rail 1 be the one indicated with the letter C, while the level for the rail 11 will be the one indicated with the letter D. The difference E, D between said two levels C and D respectively will thus be the depth of excavation and substructure, which, is gained by the application of the present invention. Sleepers are not required in connection with the invention, the track being fastened in a suitable manner, by way of example, by means of clamps or bolts on the top surface of the substructure 14, which is arranged between the levels A and B in the upgrade, and which by way of example can comprise gravel etc.

A surface coating 15, as for example bitumen, is thereafter deposited on top of the crushed stone 16, and suitably in such a way that the bitumen 15 will force its way under the flanges 7, 8 into the interspace between their undersides 7B, 8B and said crushed stone 16, and in such a manner that the upper level of the bitumen after its treatment will be located level to the rail 1, as has been described above.

The invention is not limited to the example of embodiment illustrated in the drawings and described above, but can be varied as to its details within the scope of the following claims.

I claim:

1. The combination of a rail for a track vehicle, and of a rail bed; said rail having: an essentially vertically extending web having an upper end and a lower end, a foot connected to the lower end of said web and having two lateral extensions extending transversely of said web in opposite directions, and a head connected to said upper end of said web, said head having a running surface for said track vehicle and two flanges extending from said head transversely to said web in opposite directions and having outer portions located essentially at the level of said running surface, said extensions being of a first width, said flanges being of a second width, said second width being greater than said first width; said flanges resting on said bed and constituting essentially the sole support for the rail for absorbing substantially all of the load exerted by a track vehicle on said rail.

2. The combination according to claim 1, wherein the relationship of said second width to said first width is at least approximately 2:1.

3. The combination according to claim 1, wherein the relationship of said second width of said first width is at least approximately 3:1.

4. The combination according to any one of claims 1 to 3, wherein said two flanges extend by an equal amount from said web.

5. The combination according to any one of claims 1 to 3, comprising a groove in said head adjacent to said running surface for receiving a flange of a wheel of a track vehicle.

6. The combination according to claim 5, wherein said two flanges have inner portions respectively connected at different levels to said web, and wherein said groove extends in the inner portion of one of said flanges.

7. The combination according to any one of claims 1 to 3, wherein said two flanges have undersides facing said bed, said undersides being inclined with respect to said web, and wherein said foot has an underside which extends horizontally.

* * * * *